US008326472B2

(12) United States Patent
Igarashi et al.

(10) Patent No.: US 8,326,472 B2
(45) Date of Patent: Dec. 4, 2012

(54) AUTOMATIC VESSEL POSITION HOLDING CONTROL METHOD AND CONTROLLER

(75) Inventors: Kazuyuki Igarashi, Tokyo (JP); Hiroshi Yamaguchi, Tokyo (JP); Satoru Nagase, Tamano (JP); Koh Murata, Tamano (JP); Masakatsu Saito, Yokosuka (JP); Eigou Miyazaki, Yokosuka (JP)

(73) Assignees: Mitsui Engineering & Shipbuilding Co., Ltd., Tokyo (JP); Japan Agency for Marine-Earth Science and Technology, Yokosuka (JP)

( * ) Notice: Subject to any disclaimer, the term of this patent is extended or adjusted under 35 U.S.C. 154(b) by 0 days.

(21) Appl. No.: 13/137,493

(22) Filed: Aug. 22, 2011

(65) Prior Publication Data

US 2011/0307128 A1 Dec. 15, 2011

Related U.S. Application Data

(62) Division of application No. 11/887,954, filed as application No. PCT/JP2006/307981 on Apr. 14, 2006, now abandoned.

(30) Foreign Application Priority Data

Apr. 15, 2005 (JP) ..... 2005-118064
Apr. 15, 2005 (JP) ..... 2005-118065

(51) Int. Cl.
*G05D 1/00* (2006.01)
*G06F 7/00* (2006.01)

(52) U.S. Cl. ..... 701/21; 701/1; 701/36; 701/41

(58) Field of Classification Search ..... 440/84, 440/85, 86, 87
See application file for complete search history.

(56) References Cited

U.S. PATENT DOCUMENTS

2003/0131777 A1* 7/2003 Fischer, III ..... 114/230.1
2006/0247857 A1* 11/2006 Zeng et al. ..... 702/2

FOREIGN PATENT DOCUMENTS

JP 61-247592 A 11/1986
JP 6-64589 A 3/1994
JP 7-223591 A 8/1995
JP 2002-234494 A 8/2002
JP 2003-185743 A 7/2003

OTHER PUBLICATIONS

Aalbers et al. (An application of dynamic positioning control using wave feed forward; International Journal of Robust and Nonlinear Control 2001; 11: 1207-1237).

* cited by examiner

*Primary Examiner* — Ian Jen
(74) *Attorney, Agent, or Firm* — Kubovcik & Kubovcik

(57) ABSTRACT

An automatic vessel position holding control method for holding a vessel position and a vessel heading of a vessel on the ocean in order to reduce a positional deviation and a heading deviation sharply as compared with the conventional automatic vessel position holding control by performing feedforward control for estimating and then compensating for at least one of a wave drifting force and a wave drifting moment that act on the vessel, wherein a vessel position holding control is performed that includes such controls as estimating waves entering the vessel from motion thereof, calculating at least one of the wave drifting force and the wave drifting moment from the estimated waves and performing feedforward control for at least one of the calculated wave drifting force and the calculated wave drifting moment.

7 Claims, 7 Drawing Sheets

AUTOMATIC VESSEL POSITION HOLDING CONTROL METHOD AND CONTROLLER

This application is a division of application Ser. No. 11/887,954, filed Oct. 5, 2007 now abandoned, which is a 371 of international application PCT/JP2006/307981, filed Apr. 14, 2006, which claims priority based on Japanese Patent Application Nos. 2005-118064 and 2005-118065, both filed Apr. 15, 2005, and which are incorporated herein by reference.

BACKGROUND OF THE INVENTION

The present invention relates to an automatic vessel position holding control method and an automatic vessel position holding controller and more particularly to an automatic vessel position holding control method, a wave drifting force estimating method, an automatic vessel position holding controller and a dynamic positioning system which can drastically reduce deviations of a vessel position by performing feedforward control that estimates at least one of a wave drifting force and a wave drifting moment caused by waves and compensates for at least one of the estimated wave driving force and wave drifting moment or by performing feedforward control which estimates a long-period varying force that includes a varying wave drifting force by waves and compensates for the estimated long-period varying force.

DESCRIPTION OF THE RELATED ART

A DPS (Dynamic Positioning System) is a device that automatically holds a vessel on the ocean in a stationary position against external forces such as tides, wind and waves by controlling a propeller and a thruster for propelling with a computer rather than with an anchor while a ship/marine structure engaged in investigation or development is at work on the ocean. With this device, an actuator such as a thruster is normally controlled so that deviation between a target position and a current position becomes zero and a vessel is held in a stationary position by this control force.

This automatic vessel position holding device is particularly effective in oceanic areas where anchors can not be used. Using workboats, research vessels, marine structures and the like, needs for ocean development are increasing and a target water area for drilling the sea bottom for resources, ocean surveys and the like are increasing in depth.

However, if large environmental fluctuations occur, as in rough sea condition, when feedback control is performed after detecting positional deviations, delays in control can be generated. Thus, the automatic vessel position holding control is not always to be performed with sufficient accuracy. And regarding a wind pressure, a control wherein a force and a moment by a wind currently acting on the vessel is estimated based on a wind direction and a wind speed measured with a wind direction/wind speed indicator and the wind pressure and the wind pressure moment are compensated for before a positional deviation is generated, that is, so-called feedforward control has been employed.

On the other hand, it can be considered that wave force and moment are divided into a force and a moment called as a wave exciting force and a wave exciting moment which vary with a wave period (positively/negatively vary) and a wave drifting force and a wave drifting moment that push a vessel in a certain direction and that vary over a relatively long period. The wave drifting force and wave drifting moment are of a relatively long period but vary in magnitude. Therefore, similar to the wind pressure and the wind pressure moment, the wave drifting force and the wave drifting moment can negatively influence DPS position control. Therefore, with the automatic vessel position holding control, taking the wave drifting force and the wave drifting moment into consideration is important.

However, with the conventional dynamic positioning system, no special measures are taken for the varying wave drifting force and wave drifting moment. Therefore, even when a large wave drifting force, a large wave drifting moment, a varying wave drifting force and a varying wave drifting moment act on the vessel, the feedback control does not work until the positional deviation and the heading deviation become significant values to some extent. And as a result, a delay in control is caused and the positional deviation and the heading deviation increase. Thus, it is necessary to perform the feedforward control which estimates the wave drifting force, wave drifting moment, the varying wave drifting force and varying wave drifting moment and compensates for the wave drifting force, the wave drifting moment, the varying wave drifting force and the varying wave drifting moment.

However, there is no means of measuring physical amounts for waves which would enable easy estimation of the wave drifting force and the wave drifting moment, for example a wind direction/wind speed indicator which enables estimating the wind pressure and the wind pressure moment. Thus, there is the problem that the wave drifting force and the wave drifting moment along with the varying wave drifting force and the varying wave drifting moment can not be utilized easily in control.

As described in Japanese Patent Application Kokai Publication No. 2002-234494, an automatic ship steering device is proposed wherein the size of the automatic ship steering device such as a fire boat is reduced in order to improve operability. With the automatic ship steering device, a forward/backward propeller and a thruster are operated by operation of a joy stick, and control means is included for realizing a holding function that holds a ship position detected by ship position detecting means through operating an operation switch for holding a stationary point.

This automatic stationary point holding system of the automatic ship steering device has a ship position holding function/heading holding function and operates propulsive force of a forward/backward propeller and the thruster generating a propulsive force in the lateral direction so that the values become zero by detecting right-and-left positional deviation, fore-and-aft positional deviation and vessel heading deviation. However, the algorithm is not explicitly described. Also, there is no description of waves, and waves are not taken into consideration.

Also, as described in Japanese Patent Application Kokai Publication No. H06-64589, a vessel position automatic holding method for a vessel is proposed wherein a stern thruster is not needed and a propeller is a fixed pit type operated in a single forward direction. In this method, deviations of the position of the vessel and attitude from predetermined positions are calculated, and the forward/backward propeller, combination of two rudders and a bow thruster are controlled so that the vessel is held in a predetermined position. In this vessel position automatic holding method, the force and direction of wind and tide are taken into consideration but waves are not.

Patent Document 1: Japanese Patent Application Kokai Publication No. 2002-234494

Patent Document 2: Japanese Patent Application Kokai Publication No. H06-64589

SUMMARY OF THE INVENTION

The present invention was made in order to solve the above problems and has an objective to provide an automatic vessel position holding control method and an automatic vessel position holding controller which can drastically reduce positional deviation and heading deviation as compared with a conventional automatic vessel position holding control by performing feedforward control for compensating at least one of a wave drifting force and a wave drifting moment by estimating at least one of the wave drifting force and the wave drifting moment acting on a vessel or by performing feedforward control for compensating a long-period varying force and a long-period varying moment by estimating the long-period varying force and the long-period varying moment including at least one of the varying wave drifting force and the varying wave drifting moment acting on the vessel.

In order to achieve the above object, the automatic vessel position holding control method for holding a vessel position and a heading of a vessel on the ocean according to the present invention is characterized in that at least one of the wave drifting force and the wave drifting moment caused by waves is calculated and vessel position holding control is performed including control performing feedforward control for at least one of the calculated wave drifting force and wave drifting moment.

According to the automatic vessel position holding control method with this configuration, before the vessel is moved by the wave drifting force and the wave drifting moment, at least one of the wave drifting force and wave drifting moment acting on the vessel is estimated, and feedforward control is performed for compensating at least one of the wave drifting force and the wave drifting moment. Therefore, the positional deviation of the vessel (difference between the current position and the target position) can be extremely reduced as compared with the conventional automatic vessel position holding control method.

In the above automatic vessel position holding control method, waves incident on the vessel are estimated from the motion of the vessel, and at least one of the wave drifting force and wave drifting moment is calculated from the estimated waves. This wave drifting force and wave drifting moment can be calculated approximately according to Hsu's method or Pinkster's method using a stationary wave drifting force in regular waves.

Also, in the above automatic vessel position holding control method, a pitch representative period is calculated from a pitch measured time series, and based on the pitch representative period, a wave incident angle is estimated from measured response ratio of the measured pitch and a measured roll using a wave incident angle estimation table prepared in advance, a pitch response value is calculated from the pitch representative period and the wave incident angle using a pitch response coefficient table in short crest irregular waves prepared in advance, an estimated time series of waves is calculated by multiplying the pitch measured time series by the inverse of the pitch response value, and at least one of the wave drifting force and wave drifting moment is calculated from the estimated time series of waves.

According to the calculating method of at least one of the wave drifting force and wave drifting moment, the time series of waves are estimated from the vessel motion and at least one of the wave drifting force and wave drifting moment can be calculated from the estimated time series of waves. And for at least one of the wave drifting force and wave drifting moment, the feedforward control for automatic vessel position holding can be performed.

Also, in the above automatic vessel position holding control method, when calculating at least one of the wave drifting force and wave drifting moment, from the period between zero crosses in the above estimated time series of waves and the wave height between the zero crosses, at least one of the wave drifting force and wave drifting moment corresponding to the period and wave height per half-wave length and at least one of the wave drifting force and the wave drifting moment in regular waves is set as at least one of the wave drifting force and the wave drifting moment.

According to the calculating method of the wave drifting force and the wave drifting moment from the estimated time series of waves by Hsu's method, the wave drifting force and the wave drifting moment can be calculated by a relatively simple algorithm as compared with Pinkster's method. In Hsu's method, the irregular waves are considered as a series of regular waves whose period and wave height are changing per half-wave length between zero crosses, and a stationary wave drifting force corresponding to the respective regular waves acts during the half-wave lengths. And the wave drifting force is given as step function acting during passage of the half-wave length. The calculation of the wave drifting force can be made relatively easily if a wave drifting force coefficient in regular waves is prepared in advance. With Pinkster's method, since an integration calculation using a stationary wave drifting force in regular waves is performed for each frequency component of waves to acquire the wave drifting force, calculation becomes more complicated than Hsu's method.

In the wave drifting force calculation method relating to the above automatic vessel position holding control method, a pitch representative period is calculated from a pitch measured time series in a wave drifting force estimating method for estimating at least one of the wave drifting force and the wave drifting moment acting on a vessel on the ocean, on the basis of the pitch representative period and measured response ratio between the measured pitch and the measured roll, a wave incident angle is estimated using a wave incident angle estimation table prepared in advance, a pitch response value is calculated from the pitch representative period and the wave incident angle using a pitch response coefficient table in a short crest irregular waves prepared in advance, and by multiplying the pitch measured time series by the inverse of the pitch response value, the estimated time series of waves is calculated so as to calculate at least one of the wave drifting force and the wave drifting moment from the estimated time series of waves. By this wave drifting force calculation method, time series of waves is estimated from the vessel motion and at least one of the wave drifting force and the wave drifting moment can be calculated from the estimated time series of waves.

According to the automatic vessel position holding control method and the wave drifting force calculating method, at least one of the wave drifting force and the wave drifting moment acting on the vessel can be estimated. And since the feedforward control for compensating at least one of the wave drifting force and the wave drifting moment is performed, the positional deviation and the heading deviation of the vessel can be drastically reduced as compared with the conventional automatic vessel position holding control.

Alternatively, the automatic vessel position holding control method according to the present invention in order to achieve the above objective is an automatic vessel position holding control method for holding a vessel position and a vessel heading in a predetermined position and a predetermined heading by controlling a propulsive force generating device on the ocean, characterized in that in relation to an acting force and an acting moment acting on a vessel, a long-period varying force and a long-period varying moment including at least one of a varying wave drifting force and a varying wave drifting moment for a long period generated by waves are estimated and a control for holding a vessel position is performed through feedforward control of a control force and a control moment generated by the propulsive force generating device for the estimated long-period varying force and long-period varying moment.

By the automatic vessel position holding control method according to the present invention, control can be performed giving consideration to a varying wave drifting force and a varying wave drifting moment, which has not been considered. Moreover, since feedforward control is performed for the long-period varying force and the long-period varying moment including at least one of the varying wave drifting force and varying wave drifting moment obtained by estimation, positional deviation can be extremely reduced as compared with the conventional feedback control.

In the above automatic vessel position holding control method, an acting force and an acting moment acting on a vessel are acquired by obtaining acceleration and angular acceleration of the vessel in relation to the long-period varying force and long-period varying moment and by multiplying the acceleration and the angular acceleration by a hull virtual mass and a hull virtual inertial moment, and a value obtained by subtracting a generated propulsive force and a generated moment generated by the propulsive force generating device from the acting force and the acting moment is set as estimated values of the long-period varying force and the long-period varying moment. According to this configuration, the long-period varying force and the long-period varying moment including at least one of the varying wave drifting force and the varying wave drifting moment can be estimated with a relatively simple algorithm.

That is, the acting force and the acting moment acting on the vessel can be obtained by multiplying the vessel acceleration and the vessel angular acceleration by the virtual mass and the virtual inertia moment of the vessel. On the other hand, the acting force (hereinafter, also including the moment) acting on the vessel can be divided into an environmental external force such as a wave exciting force, a varying wave drifting force by waves, a hull hydrodynamic force, which is a reaction force caused by a fluid due to motion of the vessel, a wind pressure by wind, a tidal force by a tide and the like and a control force (actuator force) generated by a propulsive force generating device (actuator) such as a thruster. A riser reaction force and the like from a riser for sea-bottom drilling are handled as a part of the environmental external force.

Therefore, by subtracting the known control force and the known control moment acting on the vessel from the acting force and the acting moment acquired from the acceleration and the angular acceleration, a short-period varying force and varying moment as well as the long-period varying force and varying moment can be obtained. Then, through eliminating the short-period varying force and varying moment by the wave exciting force and the hull hydrodynamic force, the long-period varying force and varying moment by wind pressure, tidal force, and varying wave drifting force can be estimated.

In other words, in the feedforward control, the detected vessel deviation is a result of action of the acting force acting on the vessel and the control force including the wind pressure compensation control force, tidal force compensation control force, and varying wave drifting force compensation control force. Also, the acting force calculated from the acceleration of the vessel is a sum of the environmental external force and the control force. Therefore, the environmental external force can be obtained by subtracting the control force from the acting force calculated from the acceleration of the vessel. By eliminating the short-period wave exciting force and the hull hydrodynamic force from this environmental external force, and moreover by subtracting the wind pressure and the tidal force acquired by other detecting means or calculating means, the varying wave drifting force can be obtained.

Also, by the above automatic vessel position holding control method, the acceleration and the angular acceleration are acquired by second-order derivative of the times series data of the vessel position and the vessel heading detected by the position detecting means of the vessel. By this method, noise is smaller than that in the case using the acceleration and angular acceleration directly measured by the accelerometer and angular accelerometer and estimation accuracy of the long-period varying force and long-period varying moment can be improved.

By the above automatic vessel position holding control method, the time series data of the vessel position and the vessel heading is given second-order derivative after passing them through Kalman filter so as to acquire acceleration and angular acceleration. That is, in practice, if a detected value directly measured by an accelerometer is employed for an acceleration for calculation of the acting force, only extremely large short-period varying components such as wave exciting force and the like are extracted but the long-period varying components such as the varying wave drifting force and the like are hidden. Therefore, the method is preferable that the time series data of the vessel position measured by GPS is passed through Kalman filter so as to acquire the acceleration by second-order derivative of the filter-processed positional information.

By the use of Kalman filter, the short-period components can be eliminated and the acceleration and the angular acceleration one timing ahead can be acquired with accuracy. That is, the long-period varying force and the long-period varying moment one timing ahead can be acquired with accuracy. As a result, the automatic vessel position holding can be controlled more accurately.

Also, in the above automatic vessel position holding control method, if the vessel position is detected by GPS (Global Positioning System), since the positioning accuracy by GPS has been improved, the vessel position can be obtained easily and accurately. The GPS includes not only so-called GPS but also DGPS (Differential GPS) to which devices for improving the positioning accuracy are added. The vessel heading is normally detected by a gyrocompass.

Also, for measurement of the vessel position, electric wave positioning devices such as NNSS, LORAN-C, Syledis, Argo, Maxiran, transponder and the like and positioning means by combining gyrocompass, electromagnetic log or the like may be used.

According to the automatic vessel position holding control method, the long-period varying force and the long-period varying moment including at least one of the varying wave drifting force and the varying wave drifting moment acting on the vessel can be estimated. Also, the feedforward control for compensating the long-period varying force and the long-period varying moment is performed, and the positional deviation can be extremely reduced as compared with the conventional automatic vessel position holding control method.

And the automatic vessel position holding controller according to the present invention in order to achieve the above objective comprises, in the automatic vessel position holding controller for holding the vessel position and the vessel heading of a vessel on the ocean, vessel motion measuring means for measuring the motion of the vessel including at least a pitch and a roll, wave information estimating means for calculating a pitch representative period from the pitch measured time series and estimating a wave incident angle from a measured response ratio between the measured pitch and the measured roll based on the pitch representative period using a wave incident angle estimation table prepared in advance, pitch response value calculating means for calculating a pitch response value from the pitch representative period and the wave incident angle using a pitch response coefficient table in short crest irregular waves prepared in advance, wave time-series calculating means for calculating an estimated time series of waves by multiplying the pitch measured time series by the inverse of the pitch response value, and wave drifting force calculating means for calculating at least one of the wave drifting force and the wave drifting moment from the estimated time series of waves. By this configuration, the above automatic vessel position holding control method can be carried out.

Also, in the above automatic vessel position holding controller, when the wave drifting force calculating means calculates at least one of the wave drifting force and the wave drifting moment from the estimated time series of waves, from a period between zero crosses in the estimated time series of waves and a wave height between the zero crosses, at least one of the wave drifting force and the wave drifting moment in regular waves corresponding to the period and wave height per half-wave length is calculated, and at least one of the wave drifting force and the wave drifting moment in regular waves is set as at least one of the wave drifting force and the wave drifting moment. According to the calculating method of at least one of the wave drifting force and the wave drifting moment from the estimated time series of waves by Hsu's method, at least one of the wave drifting force and the wave drifting moment can be calculated with a relatively simple algorithm as compared with Pinkster's method, and the wave drifting force calculating means is relatively simplified.

Also, the dynamic positioning system according to the present invention in order to achieve the above objective is configured to comprise, in the dynamic positioning system for holding the vessel position and the vessel heading of the vessel on the ocean, the above automatic vessel position holding controller. The dynamic positioning system of this configuration comprises the above automatic vessel position holding controller, and control can be performed while considering at least one of the wave drifting force and the wave drifting moment acting on the vessel. Thus, the positional deviation and heading deviation can be extremely reduced.

Since the wave drifting moment is generally very small, when there is no demanding request particularly for holding of the vessel heading, it is preferable to configure that the calculation and the control relating to the wave drifting moment is not performed, but only the calculation and the control relating to the wave drifting force is performed in the above automatic vessel position holding control method and automatic vessel position holding controller, since the control and the system can be simplified.

According to the automatic vessel position holding controller and the dynamic positioning system, at least one of the wave drifting force and the wave drifting moment acting on the vessel can be estimated, and feedforward control is performed for compensating at least one of the wave drifting force and the wave drifting moment. As a result, the positional deviation and heading deviation of the vessel can be extremely reduced as compared with the conventional automatic vessel holding control.

Alternatively, the automatic vessel position holding controller according to the present invention in order to achieve the above objective is an automatic vessel position holding controller for holding a vessel position and a vessel heading in a predetermined position and a predetermined heading by control of a propulsive force generating means on the ocean, comprising vessel position detecting means for detecting the vessel position and the vessel heading, generated propulsive force calculating means for calculating a control force and a control moment generated by the propulsive force generating means provided with the vessel, long-period varying force calculating means for calculating a long-period varying force and a long-period varying moment including at least one of a varying wave drifting force and a varying wave drifting moment by waves, and propulsive force generation control means for feedforward control of the control force and the control moment generated by the propulsive force generating means for the long-period varying force and the long-period varying moment calculated by the long-period varying force calculating means.

Also, the above automatic vessel position holding controller further comprises vessel acceleration calculating means for calculating acceleration and angular acceleration in a position of the center of gravity of the vessel and vessel acting force calculating means for calculating the acting force and acting moment acting on the vessel by multiplying the acceleration and the angular acceleration calculated by the vessel acceleration calculating means by a hull virtual mass and a hull virtual inertia moment, and is configured that the long-period varying force calculating means subtracts a control force and a control moment calculated by the generated propulsive force calculating means from the acting force and the acting moment calculated by the vessel acting force calculating means, so as to calculate the long-period varying force and the long-period varying moment.

Moreover, the above automatic vessel position holding controller is configured so that the vessel acceleration calculating means acquires the acceleration and the angular acceleration by second-order derivative of the time series data of the vessel position and the vessel heading detected by the position detecting device of the vessel.

Also, the above automatic vessel position holding controller is configured so that the vessel acceleration calculating means acquires the acceleration and the angular acceleration by second-order derivative after passing the time series data of the vessel position and vessel heading through Kalman filter.

Also, the above automatic vessel position holding controller is configured so that the vessel position detecting means detects the vessel position by GPS.

According to the above automatic vessel position holding controllers, the long-period varying force and long-period varying moment including at least one of the varying wave drifting force and the varying wave drifting moment acting on the vessel can be estimated. Then, the feedforward control is performed for compensating the long-period varying force and the long-period varying moment. Thus, the positional deviation can be extremely reduced as compared with the conventional automatic vessel position holding control method and the conventional automatic vessel position holding controller.

DETAILED DESCRIPTION OF THE INVENTION

First, an automatic vessel position holding control method, a wave drifting force calculating method, an automatic vessel position holding controller, and a dynamic positioning system according to an embodiment of the present invention will be described referring to the attached drawings. The force such as a wave drifting force shall include a moment such as a drifting moment except where particularly separated, and indication on the moment will be omitted in the following for simplification of the description. That is, instead of "... force and ... moment", it is indicated as "... force". Also, the vessel position includes a vessel heading, and the positional deviation of a vessel includes a heading deviation except where particularly separated.

Figure 1:
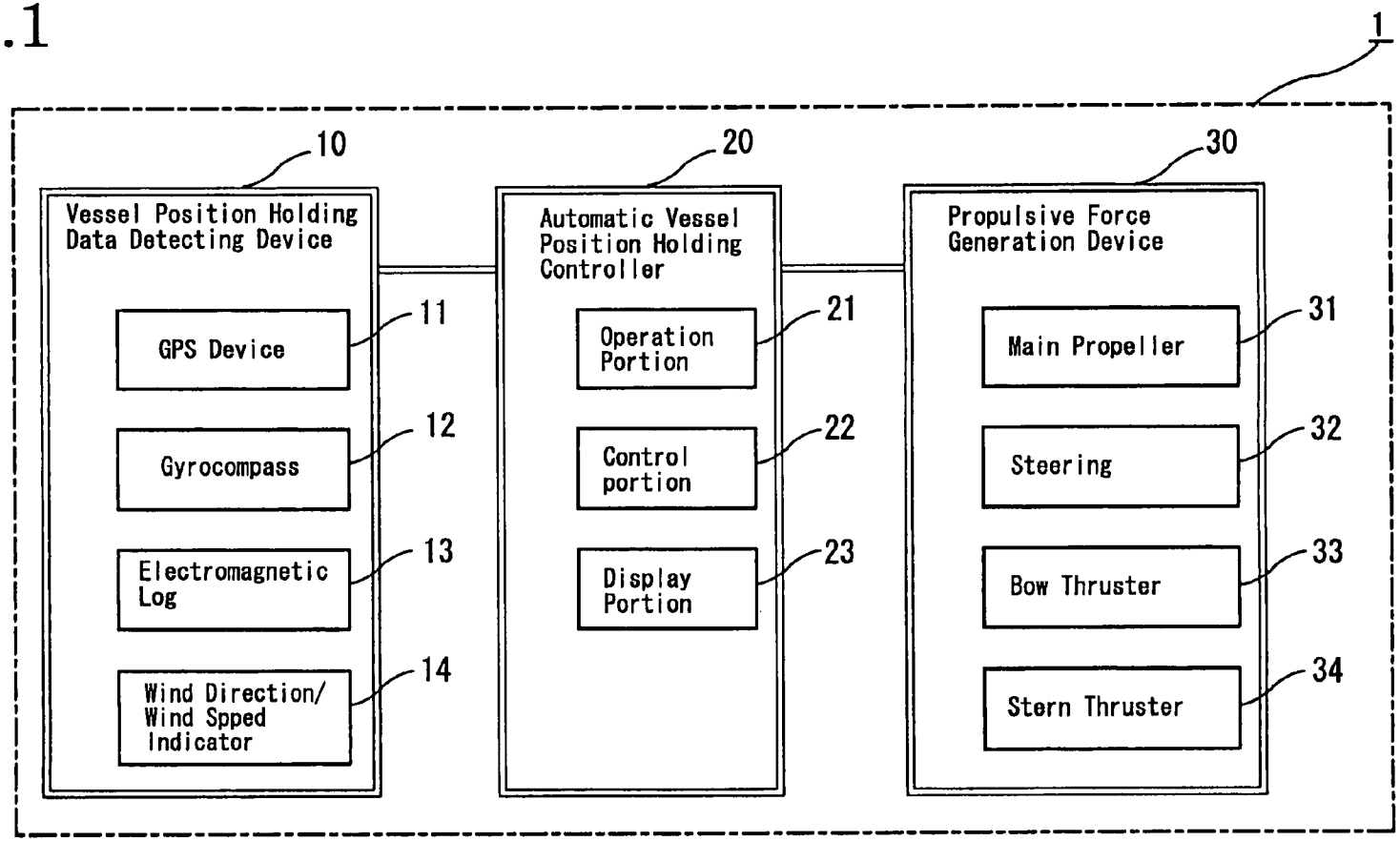
FIG. 1 is a block diagram illustrating a dynamic positioning system provided with an automatic vessel position holding controller according to the present invention.

First, a dynamic positioning system 1 provided with an automatic vessel position holding controller 20 according to the present invention will be described. As shown in FIG. 1, the dynamic positioning system 1 comprises a vessel position holding data detecting device 10 for detecting information for vessel position holding control, an automatic vessel position holding controller 20 for inputting a detected value of the vessel position holding data detecting device 10 and giving a command to a propulsive force generating device 30, and the propulsive force generating device 30 for giving a control force to the vessel according to a command output of the automatic vessel position holding controller 20.

As the vessel position holding data detecting device 10, there can be a positioning sensor, a speed sensor for detecting the ship speed (against ground, against water), an acceleration sensor, an attitude sensor (pitch angle, roll angle, yaw angle), an angular speed sensor and the like. Also, a wind force sensor, a tidal wave sensor and the like can be considered.

In this embodiment, a GPS device 11 is used as a positioning sensor for a hull longitudinal direction (surge) position and a hull lateral direction (sway) position. A gyrocompass 12 is used as a sensor for a vessel heading (yaw). An electromagnetic log 13 is used as a speed sensor for detecting the ship speed. A sensor for detecting information on six-degree-of-freedom motion of the vessel (surge: longitudinal direction of the vessel, sway: right-and-left direction of the vessel, heave: vertical direction of the vessel, roll: direction around longitudinal coordinate axis of the vessel, pitch: direction around right-and-left coordinate axis of the vessel, yaw: direction around the vertical coordinate axis of the vessel), an accelerometer and an angular accelerometer are used. As a wind force sensor, a vane type wind direction/wind indicator 14 is used. The positioning accuracy ($1\sigma$) by the GPS (global positioning system) device 11 is approximately 5 m. The symbol $\sigma$ denotes a standard deviation of a random error.

As the propulsive force generating device 30 which can give an effective control force to the vessel, a main propeller, a steering, a tunnel thruster, an heading thruster, a Schneider propeller, jet propelling or the like can be considered in general. In this embodiment, there are two units of the main propeller 31 of a variable pitch propeller, two units of the steering 32, two units of the bow thruster 33 of a tunnel-type variable pitch propeller, and two units of the stern thruster 34 of a tunnel-type variable pitch propeller.

The automatic vessel position holding controller 20 comprises an operation portion 21, a control portion 22, and a display portion 23. The operation portion 21 comprises a three-shaft joy stick and various switches. Through the operation portion 21, an operator gives an instruction to the control portion 22 or knows the state of control while watching the display portion 23.

The control portion 22 is a center of the automatic vessel position holding controller 20. In this embodiment, the device comprises two units of calculating device. The control portion 20 is used as a calculating device for control and a calculating device for monitor and exchanges data through a common memory. Modules configuring the calculating device are designed with a sufficient noise margin against power supply fluctuation and electromagnetic induction. Input/output interfaces connected to the sensors and actuators are all electrically insulated so that external troubles do not adversely affect the inside of the calculating device. Also, in order to improve reliability of the calculating device, an external auxiliary memory device having a mechanical driving portion is not employed. All the programs and data are written in a ROM module.

The control portion 22 sends/receives data to/from the vessel position holding data detecting device 10. From the detected data and instruction data obtained from communication with the operator, calculations are carried out and a command to the propulsive force generating device 30 is calculated and outputted.

The display portion 23 has a CRT display, a digital indicator, an indicator lamp and the like and displays a vessel position in target center absolute coordinate indication or one's own vessel center relative coordinate indication. The indication scale of the coordinate can be freely changed, and directions of wind and estimated stationary force can be shown on the upper left. Moreover, data display functions of a sensor state, a power state, an alarm state and the like are provided. Also, a digital display function for displaying a target position, a target heading, a positional deviation, a heading deviation, and a propeller command propulsive force, an alarm function for giving an alarm at each equipment failure, a generator overload and abnormal position holding, and a recording function for recording the operation state, operation contents and alarm contents in a cassette tape output, a printer output and the like are provided.

The dynamic positioning system 1 has four software driving modes of a standby mode, a manual mode, a semi-automatic mode, and an automatic mode. The standby mode is a mode for commanding a zero propulsive force to each propeller to give flexibility to ship steering. The manual mode is a mode for commanding a propulsive force according to the operation of the three-shaft joy stick. The semi-automatic mode is a mode which automatically holds a vessel heading at a set heading and enables a translational ship steering by the operation of the three-shaft joy stick. The automatic mode is a mode in which the vessel position and the vessel heading are automatically held in a set position and a set heading and when a vessel position set value is changed, the vessel position is changed while holding the heading, and when a heading set value is changed, the vessel is turned around while the vessel position is held.

Next, control logic of the automatic vessel position holding in a first embodiment will be described. A vessel on the ocean suffers a disturbance such as wind, tides, waves, and a control force such as a thruster (and a control moment) are generated against them. The vessel always makes a movement and generates a positional deviation (and a heading deviation) against a target position (and a target heading) set in advance. The automatic vessel position holding controller 20 calculates a control force in order to eliminate such a positional deviation and moreover to hold the stable vessel position even under the disturbance, outputs a command to compensate it to the propulsive force generating device 30 and obtains a control force required for automatic vessel position holding (hereinafter referred to as a DPS control force).

The DPS control force commanded by the automatic vessel position holding controller 20 is configured by a short-period feedback control force (hereinafter referred to as an FB control force including the moment) and a long-period feedforward control force (hereinafter referred to as an FF control force including the moment). That is, DPS control force=FB control force+FF control force.

The FB control force is a control force exerted based on the positional deviation and the heading deviation of the vessel and a force for feedback control calculated using proportional control, derivative control, integral control and the like. Therefore, if there is no positional deviation of the vessel, no FB control force is generated.

On the other hand, the FF control force corresponds to a long-period varying force substantially close to a stationary force. The FF control force is a compensation control force for feedforward control commanded to realize stable control against a long-period varying force acting on the vessel regardless of presence of the positional deviation. The FF control force includes a wind pressure compensation control force FFw relating to a wind pressure, a tide compensation control force FFc relating to a tidal force, and a wave drifting force compensation control force FFd. That is, FF control force=wind pressure compensation control force+tide compensation control force+wave drifting force compensation control force.

With regard to the wind pressure compensation control force FFw among them, by estimating a wind pressure currently suffered by the vessel in real time based on data of relative wind direction and relative wind force from a wind direction/wind indicator, the wind pressure compensation control force FFw against the wind pressure can be calculated. In order to estimate an accurate wind pressure, a wind-tunnel test data conducted using a scale model of the vessel is used.

Also, the tide compensation control force FFc is rarely generated except specific oceanic areas and tides can be measured relatively easily in the specific oceanic areas. Therefore, the tide compensation control force FFc can be estimated in advance. Even if direct estimation is not possible, since the tidal force normally becomes substantially constant over a long period, the tidal force can be detected from detected position data of the automatic vessel position holding control and the tide compensation control force FFc compensating the tidal force can be calculated.

In the present invention, with regard to the remaining wave drifting force compensation control force FFd, waves incident on the vessel from the vessel motion are estimated, and the wave drifting force compensation control force FFd is calculated from the estimated waves. Therefore, the feedforward control can be also performed for the wave drifting force compensation control force FFd.

Figure 2:
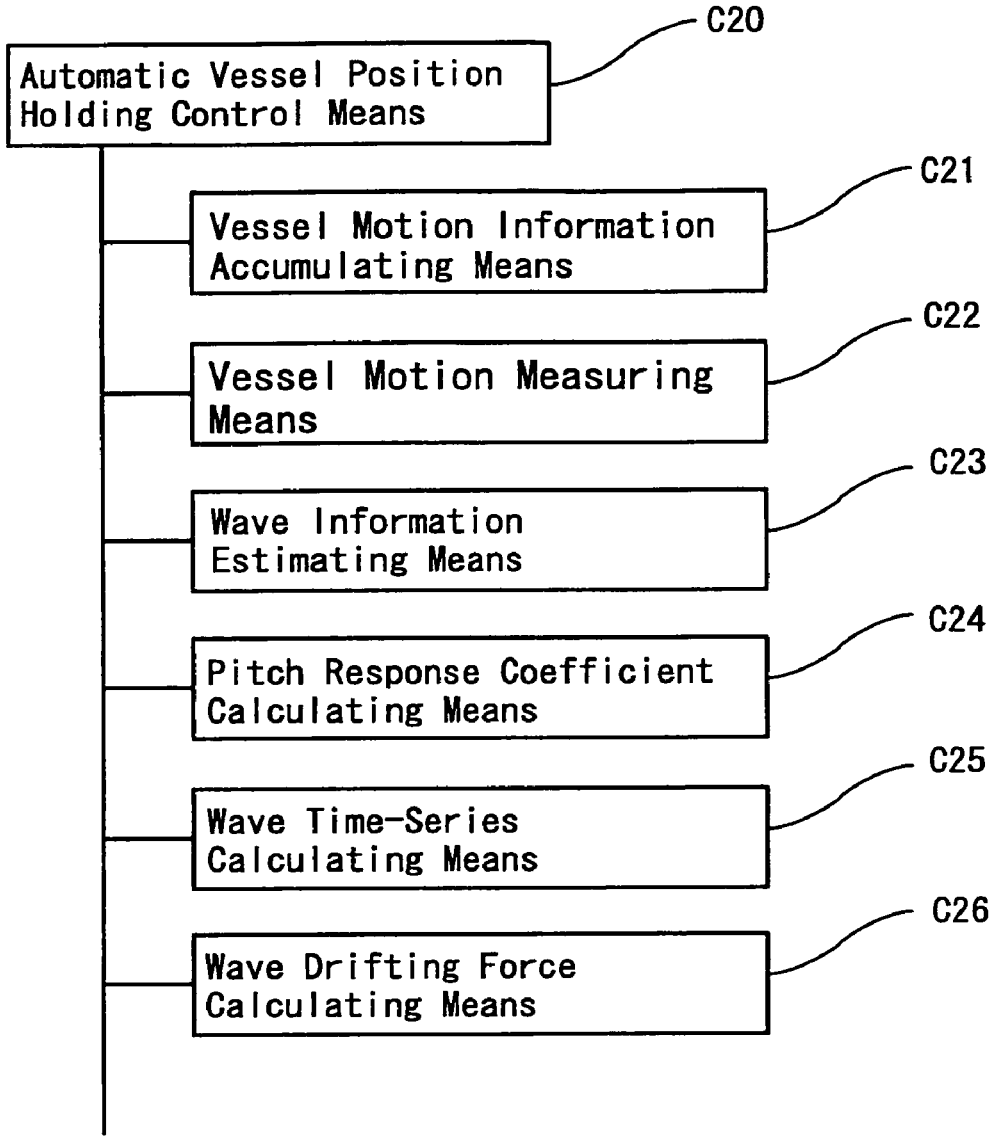
FIG. 2 is a diagram illustrating a configuration of control means of the automatic vessel position holding controller according to the present invention.

For the automatic vessel position holding control, in the first embodiment, automatic vessel position holding control means C20 of the automatic vessel position holding controller 20 comprises, as shown in FIG. 2, vessel motion information accumulating means C21, vessel motion measuring means C22, wave information estimating means C23, pitch response coefficient calculating means C24, wave time-series calculating means C25, and wave drifting force calculating means C26 and the like.

For the vessel motion information accumulating means C21, a wave incident angle estimation table T1, a pitch response coefficient table for short crest irregular waves T2, and a wave drifting force coefficient table in regular waves T3 are prepared and stored. These tables are prepared based on a response table in regular waves T01 acquiring a response value of the vessel motion to regular waves and a response table in short crest irregular waves T02.

The response table in regular waves T01 shows how the vessel makes a motion when regular waves enter the vessel at an incident angle in one direction. According to the known calculating methods of response function of a vessel in regular waves such as a strip method and a three-dimensional singularity distribution method, calculation is made for each state of the vessel (draft, trim) based on a wave incident angle, which is a direction where the wave enters and a wave period. The data of response in the regular wave is mapped into a table (map data) to have the response table in regular waves T01.

The response table in short crest irregular waves T02 shows how the vessel makes a motion when irregular waves enter the vessel from a major direction of the wave. The wave direction distribution and the spectrum of irregular waves (which can be defined by an average wave period and a significant wave height) encountered by the vessel on the ocean, are assumed, the response in regular waves obtained from the response table in regular waves T01 is weighted and added in relation to the wave-direction distribution, and a short crest irregular wave response spectrum of the vessel motion is obtained by multiplying the weight of the wave energy distribution according to wave period based on the assumed wave spectrum. The significant wave height is represented by twice of the standard deviation $\sigma$ of the time series of waves, and a square of the standard deviation $\sigma$ is an area surrounded by the short crest irregular wave response spectrum of waves.

From the short crest irregular wave response spectrum of the vessel motion, a response coefficient of the motion (significant double amplitude/significant wave height) and an average period of the motion are acquired. The response coefficient and motion representative period of the response in short crest irregular waves are acquired for each state of the vessel based on the wave incident angle and the average wave period, and they are put in order to have the response table in short crest irregular waves T02. The significant double amplitude is represented by twice of the standard deviation of a of the motion time-series, and a square of the standard deviation $\sigma$ is an area surrounded by the short crest irregular wave response spectrum of the motion.

The wave-direction distribution shows a distribution of wave energy in a range of 90 degrees in the clockwise direction and 90 degrees in the counterclockwise direction around the incident direction of the wave (the wave direction with the highest wave energy) into the vessel. The wave-direction distribution is assumed to have $\chi^2$ distribution normally. Also, as the irregular wave spectrum, JONSWAP spectrum, ISSC spectrum, ITTC spectrum or the like is normally assumed.

The wave incident angle estimation table T1 relates to periods such as a pitch representative period (peak period, average period, for example), an average wave period and a roll representative period for each state of the vessel and shows a relation between a ratio of the pitch significant amplitude to the roll significant amplitude (here, referred to as a response ratio between the pitch and the roll) and a wave incident angle. The wave incident estimation table T1 is calculated from the response coefficient of a response in short crest irregular waves of a pitch and a roll. A response ratio between the pitch and the roll is acquired for each representative period of the pitch according to a wave incident angle and the ratio is put in order to have the wave incident angle estimation table T1 of a relation between the response ratio of the pitch to the roll and the wave incident angle, according to a representative period of the pitch. The table T1 is stored in the vessel motion information accumulating means C21.

When the wave spectrum is assumed to be JONSWAP type wave spectrum having a steep peak in the wave spectrum, a period of a peak (peak period) of a pitch motion spectrum acquired from the motion spectrum is used as a representative period of the pitch. Other than this, an average period of the pitch motion can be also used. When estimating this wave incident angle, an average wave period or a roll representative period can be also used instead of the pitch representative period.

Next, the pitch response coefficient table in short crest irregular waves T2 shows a relation between a wave incident angle and a pitch response coefficient (pitch significant double amplitude/significant wave height) of a motion in irregular waves, relating to the pitch representative period according to the state of the vessel. From the pitch response in the irregular wave, the pitch representative period and the pitch response coefficient are calculated according to the wave incident angle, they are put in order to have as the pitch response coefficient table in short crest irregular waves T2. This Table T2 is stored in the vessel motion information accumulating means C21.

Also, based on the wave incident and the wave incident angle according to the state of the vessel, a wave drifting force coefficient obtained by making the wave drifting force (surge force, sway force, yaw moment) dimensionless by the representative length (ship length, for example) or the wave height, is calculated by a known method such as a three-dimensional singularity method. The calculated results are stored in the vessel motion information accumulating means C21 as the wave drifting force coefficient table in regular waves T3.

The vessel motion measuring means C22 is means for measuring the motion of the vessel. The vessel motion measuring means C22 usually measures a six-degree-of-freedom motion, but here, it measures at least a pitch and a roll. The angles of the pitch and the roll are detected through angular sensors or angular acceleration sensors. However, instead of the angular acceleration sensor, the angular acceleration can be detected from the acceleration sensor and a longitudinal distance or lateral distance between the vertical acceleration sensor and a position of the center of gravity of the vessel. From these detection results, a pitch time series and a roll time series are acquired. The data during the predetermined period of these time series is analyzed through frequency analysis (spectrum analysis) such as Fast Fourier Transform analysis, and motion spectrums of the pitch and the roll are calculated. From the motion spectrums, measured values of the response ratio of the pitch and the roll are acquired.

The wave information estimating means C23 is means for estimating a wave incident angle and applies frequency analysis of the measured pitch time series and the roll time series. That is, from the measured pitch spectrum and the measured roll spectrum, the pitch significant double amplitude and the roll significant double amplitude are calculated. From the ratio of the both, the measured response ratio of the pitch and the roll (ratio between the pitch significant amplitude and the roll significant amplitude) is acquired. Also, a representative period of a pitch motion is calculated according to the pitch representative period of the wave incident angle estimation table T1 prepared in advance to make it as the calculated pitch representative period. From the calculated pitch representative period and the response ratio of the measured pitch and roll, the wave incident angle is calculated using the wave incident angle estimation table T1 prepared in advance.

The pitch response coefficient calculating means C24 is means for calculating a pitch response coefficient. From the wave incident angle and the calculated representative wave period, the pitch response coefficient is calculated using the pitch response coefficient table in short crest irregular waves T2 prepared in advance.

The wave time-series calculating means C25 is means for calculating an estimated time series of waves. The estimated time series of waves is calculated by multiplying the measured pitch time-series by the inverse of the pitch response coefficient calculated by the pitch response coefficient calculating means C24.

The wave drifting force calculating means C26 is means for calculating the wave drifting force. The wave drifting force calculating means C26 calculates the wave drifting force by Hsu's method from the calculated estimated time series of waves. Here, the wave drifting force by irregular waves is approximated by a wave drifting force in regular waves. First, a zero-cross position of the estimated time series of waves is detected, and a wave period is calculated from time between two zero crosses. A wave height is acquired from an extreme value of the zero cross period. During the zero cross period, a constant wave drifting force is considered to act on the vessel, the calculated wave incident angle and twice of the zero-cross period are set as the wave incident angle and the wave period of regular waves, and a wave drifting force coefficient is acquired per half-period of waves, that is, per zero cross period using the wave drifting coefficient table in regular waves T3 prepared in advance. And from this wave drifting force coefficient, the wave drifting force is calculated.

Next, the automatic vessel position holding control method will be described according to the automatic vessel position holding control flow shown in FIG. 3. The automatic vessel position holding control flow shown in FIG. 3 comprises preparation for each table at Step S10, calculation of a wave drifting force at Step S20, calculation of a wind pressure at Step S30, calculation of a tidal force at Step S40, calculation of an FF control force (feedforward control force) at Step S50, calculation of an FB control force (feedback control force) at Step S60, and instruction of a DPS control force at Step S70.

Figure 4:
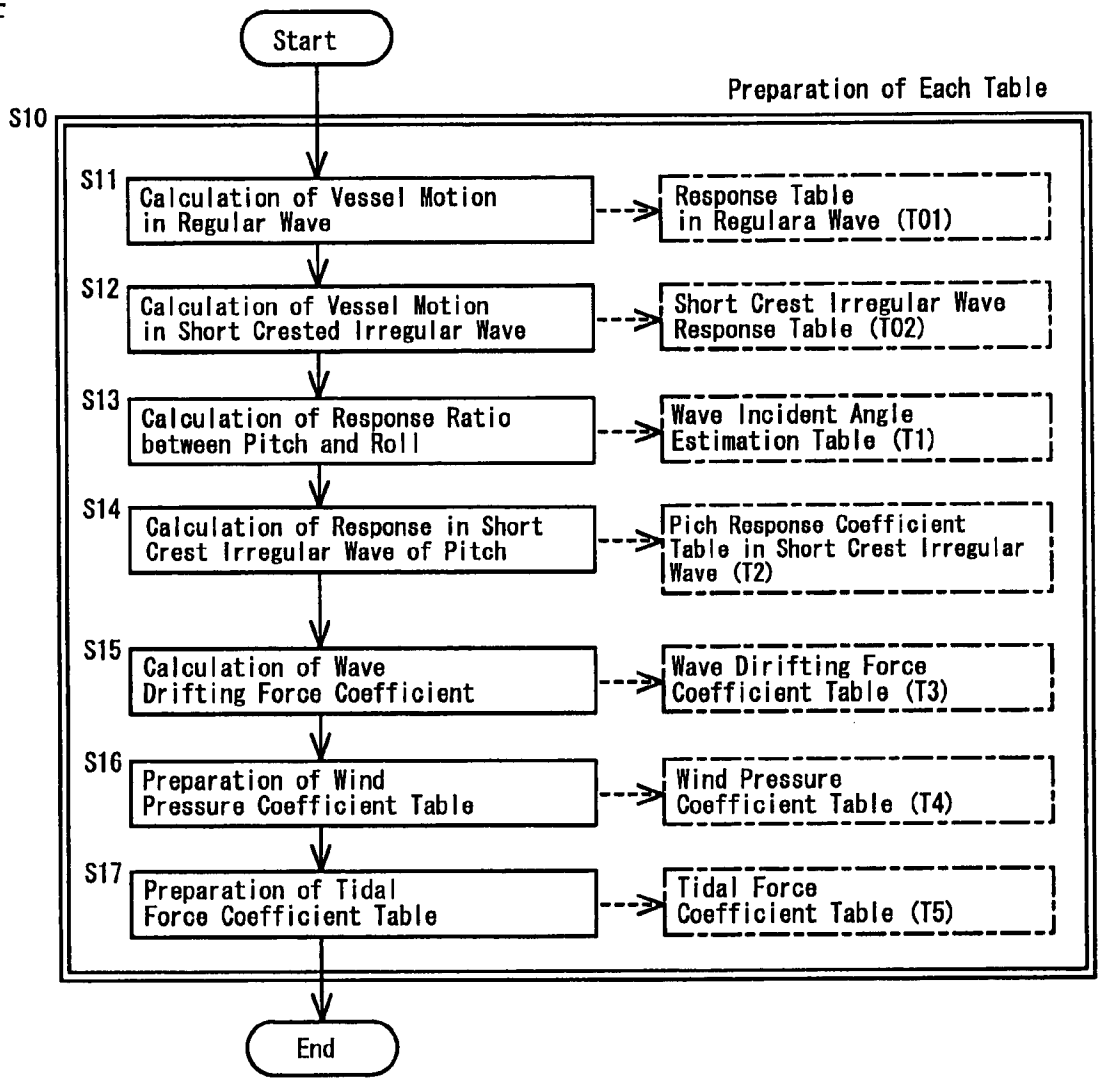
FIG. 4 is a diagram illustrating a preparation flow of each table.

As preparation, at Step S10, the wave incident angle estimation table T1, the pitch response coefficient table in short crest irregular waves T2, the wave drifting force coefficient table in regular waves T3 and the like are prepared by the vessel motion information accumulating means C21. The preparation of each table at Step S10 is usually made before the vessel goes to sea. At Step S10, as shown in FIG. 4, the vessel motion in regular waves is calculated by the strip method or three-dimensional singularity method at Step S11, and the response table in regular waves T01 showing vessel motion data for the wave incident angle and the wave period, is prepared for each state of the vessel.

At the next Step S12, based on the response in regular waves, the response table in short crest irregular waves T02 for assumed wave spectrum group is prepared based on the wave incident angle, the average wave period for each state of the vessel. The response table in short crest irregular waves T02 shows statistical data of the vessel motion in irregular waves for the wave incident angle and the average wave period, for each state of the vessel.

At the subsequent Step S13, the pitch significant double amplitude/significant wave height and the roll significant double amplitude/significant wave height are acquired from the response table in short crest irregular waves T02, the response ratio between the pitch and the roll, which is a ratio of the both, is calculated, and the wave incident angle estimation table T1 showing the response ratio between the pitch and the roll for the wave incident angle and the pitch representative period, is prepared for each state of the vessel. This table T1 is stored in the vessel motion information accumulating means C21 in advance. Also, at Step S14, the pitch representative period and the pitch significant double amplitude/significant wave height are calculated from the response table in short crest irregular waves T02 are calculated, and the pitch response coefficient table in short crest irregular waves T2 is prepared for each state of the vessel. This table T2 is stored in the vessel motion information accumulating means C21 in advance.

At Step S15, the vessel motion in regular waves is calculated by the strip method or the three-dimensional singularity method, and the wave drifting force coefficient table T3 showing the wave drifting force coefficient for the wave incident angle and the wave period, is prepared for each state of the vessel. The table T3 is stored in the vessel motion information accumulating means C21 in advance. At the subsequent Step S16, from an air-tunnel test data or the like conducted using a scale model of the ship, a wind pressure table T4 showing a wind pressure for the relative wind direction and the relative wind force, is prepared. This table T4 is stored in the vessel motion information accumulating means C21 in advance. Also, at Step S17, a tidal force table T5 showing the tidal force for the tidal direction and the tidal speed, is prepared from the tank test results or the like conducted using the scale model of the vessel. This table T5 is stored in the vessel motion information accumulating means C21 in advance.

Figure 5:
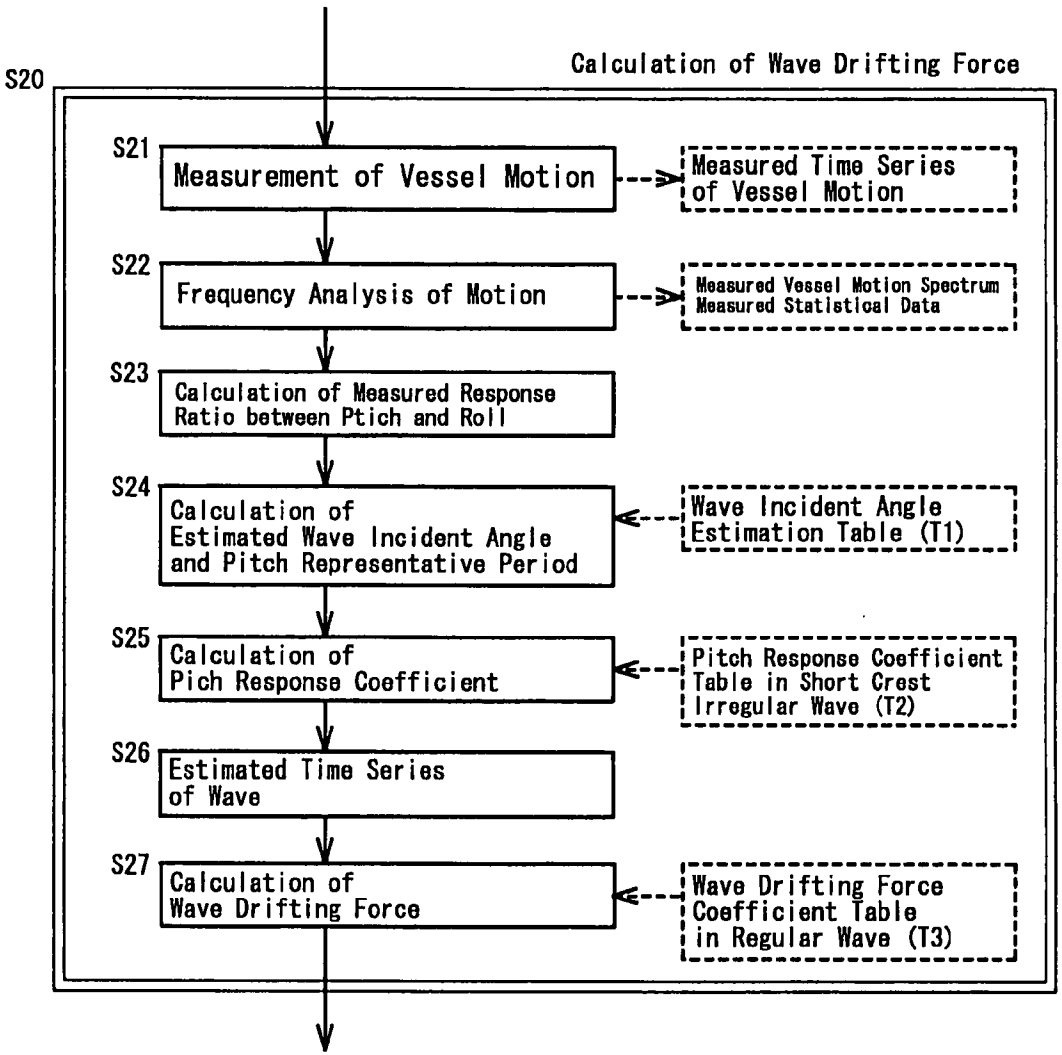
FIG. 5 is a diagram illustrating a calculation flow of a wave drifting force.

Next, the calculation flow of the wave drifting force at Step S20 will be described. In each Step in the following, the same state of the vessel on the ocean is used for the vessel state in each table. At Step S20, as shown in FIG. 5, the vessel motion (particularly, a pitch and a roll) is measured by the vessel motion measuring means C22, and the measured time series of the vessel motion is acquired at Step S21. Also, at Step S22, the measured time series of the vessel motion is given frequency analysis by Fast Fourier Transform analysis or the like within the predetermined period, the measured vessel motion spectrum is calculated, and statistical data such as measured average period, measured peak period, measured significant double amplitude and the like is calculated.

At the subsequent Step S23, from the measured statistical data of the motion, the measured response ratio between the pitch and the roll, which is a ratio between the pitch measured significant double amplitude and the roll measured significant double amplitude, is acquired by the wave information estimating means C23. At Step S24, from the measured response ratio between the pitch and the roll, a wave incident angle is acquired using the wave incident angle estimation table T1 prepared by the vessel motion information accumulating means C21. Also, the measured peak period of the pitch motion or the measured average period or the like is set as the pitch representative period.

At Step S25, a pitch response coefficient is acquired by the pitch response coefficient calculating means C24 from the calculated pitch representative period and the wave incident angle, using the pitch response coefficient table in short crest irregular waves T2 prepared by the vessel motion information accumulating means C21. At Step S26, the estimated time series of waves is acquired by the wave time-series calculating means C25 by multiplying the pitch measured time series by the inverse of the pitch response coefficient. At the subsequent Step S27, the zero-cross period and the wave height are detected from the estimated time series of waves by the wave drifting force calculating means C26. Twice of the zero-cross period is set as the wave period, and using the wave drifting coefficient table in regular waves T3 prepared by the vessel motion information accumulating means C21, the wave drifting force is calculated per half period, that is, per zero-cross period. The wave drifting force acts in the stepped state during the zero cross period.

Figure 3:
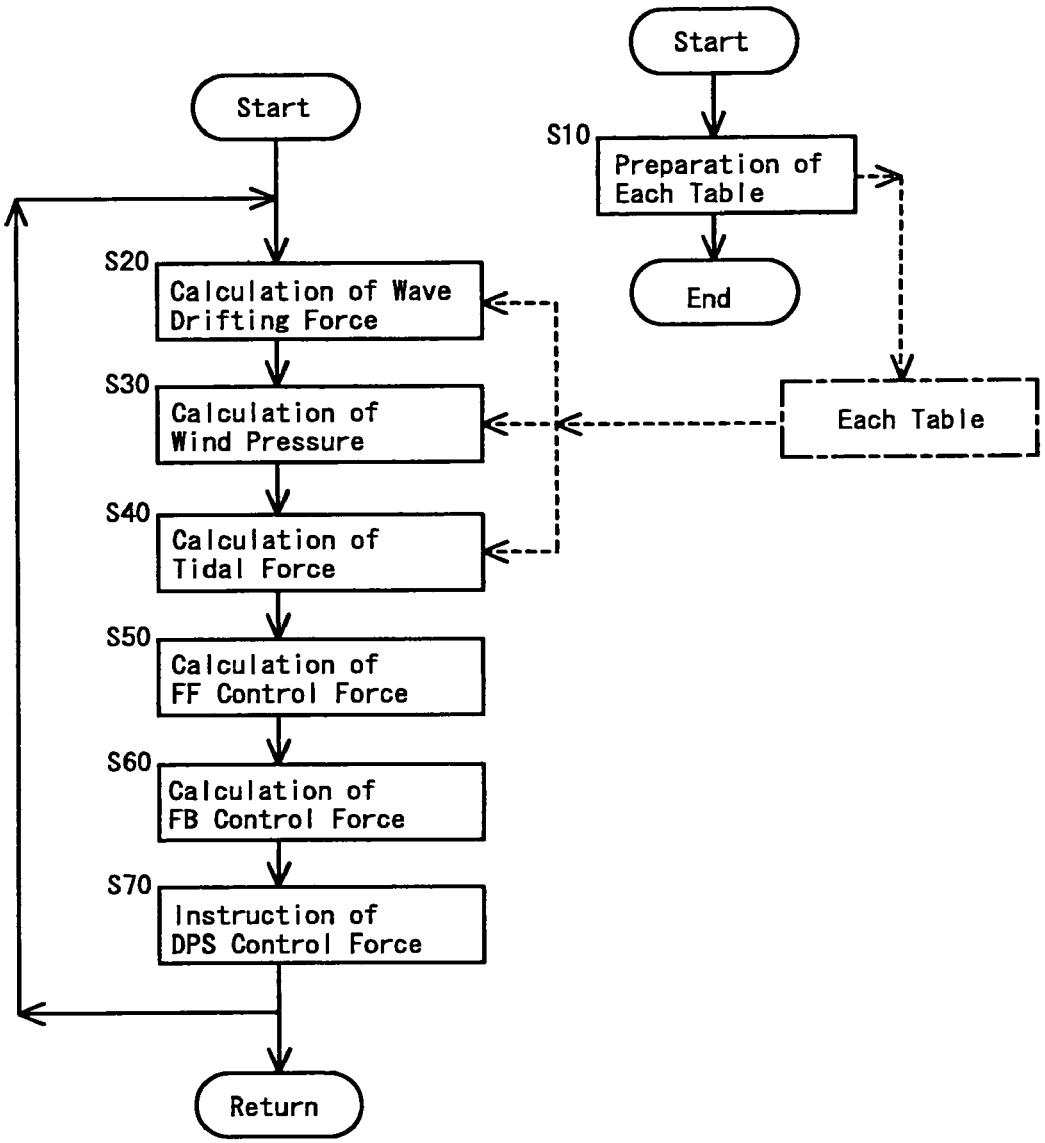
FIG. 3 is a diagram illustrating an automatic vessel position holding control flow according to the present invention.

Next, in the wind pressure calculation flow at Step S30 shown in FIG. 3, from the data of the relative wind direction and the relative wind force measured by the wind direction/wind indicator, the wind pressure acting on the vessel at control is estimated in real time using the wind pressure table T4 prepared by the vessel motion information accumulating means C21.

Also, as for the tidal force calculation flow at Step S40, the tidal force is rarely generated other than specific oceanic areas. However, if the tide is known in advance, using the tidal force table T5 prepared by the vessel motion information accumulating means C21, the tidal force acting on the vessel at control is calculated from the tidal direction and the tidal speed. Also, even if the tidal direction and the tidal speed can not be directly measured or estimated, since the tidal force is a force to become substantially constant over a long period, the tidal force can be detected from the position detection data for the automatic vessel position holding control.

In the calculation flow of the FF control force (feedforward control force) at Step S50, the wave drifting force calculated at Step S20 is multiplied by minus to have an FFd control force (wave drifting force compensation control force). Also, the wind pressure estimated at Step S30 is multiplied by minus to have an FFw control force (wind pressure compensation control force). Moreover, the tidal force estimated at Step S40 is multiplied by minus to have an FFc control force (tide compensation control force). The FFd control force, the FFw control force and the FFc control force are added together to have the FF control force. That is, FF control force=FFd control force+FFw control force+FFc control force.

Also, in the calculation flow of the FB control force (feedback control force) at Step S60, the FB control force for feedback control in which the proportional control, derivative control, integral control and the like are combined, is calculated. A known control method is used for this feedback control, and the description will be omitted.

In the instruction flow of the DPS control force at Step S70, the FF control force and the FB control force are added to have the DPS control force. And an instruction output to the propulsive force generating means 30 is calculated so that the control force generated by the propulsive force generating means 30 becomes this DPS control force, and this instruction output is outputted to the propulsive force generating device 30.

According to the above-configured automatic vessel position holding control method and the automatic vessel position holding controller 20, the following control can be performed. Waves incident on a vessel are estimated from the vessel motion. From these estimated waves, a wave drifting force and a wave drifting moment acting on the vessel in waves are calculated. A control to hold the vessel position including a control for feedforward control for the calculated wave drifting force and the calculated wave drifting moment is performed.

Also, a pitch representative period is calculated from the pitch measured time series. Based on the pitch representative period, a wave incident angle is estimated from the measured response ratio of the measured pitch and the measured roll using the wave incident angle estimation table T1. A pitch response value is calculated from the pitch representative period and the wave incident angle using the pitch response value table in short crest irregular waves T2. And by multiplying the pitch measured time series by the inverse of the pitch response value, an estimated time series of waves is calculated. From this estimated time series of waves, the wave drifting force and the wave drifting moment can be calculated using the wave drifting force coefficient table T3.

Therefore, according to the automatic vessel position holding control method, the wave drifting force calculating method, the automatic vessel position holding controller 20, and the dynamic positioning system 1 in the above first embodiment, a wave drifting force and a wave drifting moment acting on a vessel can be estimated, and a feedforward control for compensating the wave drifting force and the wave drifting moment is performed. As a result, the positional deviation and the heading deviation of the vessel can be extremely reduced as compared with the conventional automatic vessel position holding control.

Since a varying wave drifting moment is small in general, if there is no demanding request for holding particularly the vessel heading, calculation and control relating to the varying wave drifting moment is not performed in the above automatic vessel position holding control method and the automatic vessel position holding controller, but it is so configured that only the calculation and the control relating to a varying wave drifting force is performed. This configuration is preferable since the control and the system are simplified.

Next, control logic of the automatic vessel position holding in a second embodiment will be described. A vessel on the ocean suffers a disturbance such as wind, tides and waves. And a control force such as a thruster and a control moment are generated against them. However, the vessel always makes a movement and a positional deviation and a heading deviation against a target position and a target heading set in advance are generated. The automatic vessel position holding controller 20 calculates a control force and a control moment in order to eliminate the positional deviation and the heading deviation and moreover to hold the stable vessel position even under the disturbance. And a command to compensate for them is outputted to the propulsive force generating device 30 and a control force and a control moment required for automatic vessel position holding (hereinafter referred to as a DPS control force including the moment) are obtained.

The DPS control force commanded by the automatic vessel position holding controller 20 is configured by a short-period feedback control force (hereinafter referred to as an FB control force including the moment) and a long-period feedforward control force (hereinafter referred to as an FF control force including the moment) (DPS control force=FB control force+FF control force).

The FB control force is a control force exerted based on the positional deviation and the heading deviation of the vessel, and the magnitude of an estimated vessel speed. And the FB control force is a force and a moment for feedback control calculated using proportional control and derivative control. Therefore, if there is no positional deviation or heading deviation of the vessel, no FB control force is generated.

On the other hand, the FF control force corresponds to a long-period varying force substantially close to a stationary force. And the FF control force is a compensation control force for feedforward control commanded to realize stable control against a long-period varying force acting on the vessel by a wind pressure, a tidal force and a wave drifting force, regardless of the presence of the positional deviation and the heading deviation.

The FF control force includes a wind pressure compensation control force and moment, relating to a wind pressure. For the wind pressure compensation control force and moment, based on the data of relative wind direction and relative wind force from the wind direction/wind indicator, the wind pressure currently acting on the vessel is estimated in real time and the wind pressure compensation control force against the wind pressure can be calculated. In order to estimate an accurate wind pressure, an air-tunnel test data conducted using a scale model of the vessel is used.

However, with the automatic vessel position holding control method in the second embodiment, since there is no need to separate the wind pressure, the tidal force and the varying wave drifting force in practice, those including the wind pressure as well as the wind pressure moment, the tidal force as well as the tidal moment, and the varying wave drifting force as well as the varying wave drifting moment are referred to as a long-period varying force as well as a long-period varying moment. The long-period varying force and the long-period varying moment include the varying wave drifting force and the varying wave drifting moment. Since the information about the waves to estimate these forces and moments is not able to be accurately detected, it is not able to be directly estimated from the detection data of waves and the like with sufficient accuracy.

In the second embodiment, the long-period varying force and the long-period varying moment including the varying wave drifting force and the varying wave drifting moment are estimated and calculated, from time series data of the vessel position using Kalman filter. By using this Kalman filter, the vessel motion is estimated and calculated from temporal change in the vessel position and the vessel heading, while considering the influence to the vessel motion by the DPS control force acting on the vessel. The long-period varying force and the long-period varying moment are estimated and calculated, using the vessel motion estimated value and the calculated value of the DPS control force generated by the propulsive force generating device 30.

By estimating the long-period varying force and the long-period varying moment, the DPS control force can be exerted against the long-period varying force and the long-period varying moment including the varying wave drifting force and the varying wave drifting moment, regardless of the presence of the positional deviation or the heading deviation of the vessel. Therefore, the long-period varying force and the long-period varying moment are calculated, and before the positional deviation or the heading deviation is generated, the values obtained by multiplying the long-period varying force and the long-period varying moment by minus are added to the DPS control force as the compensation control force and the compensation control moment against the long-period varying force and the long-period varying moment, that is, as the FF control force.

Next, configuration of the automatic vessel position holding controller 20 for feedforward control by calculating the FF control force for the long-period varying force and the long-period varying moment including the varying wave drifting force and the varying wave drifting moment will be described. Since the feedback control of the automatic vessel position holding control of the conventional art can be used as the feedback control based on a short-period FB control force and is well known, particular description is not made here.

Figure 6:
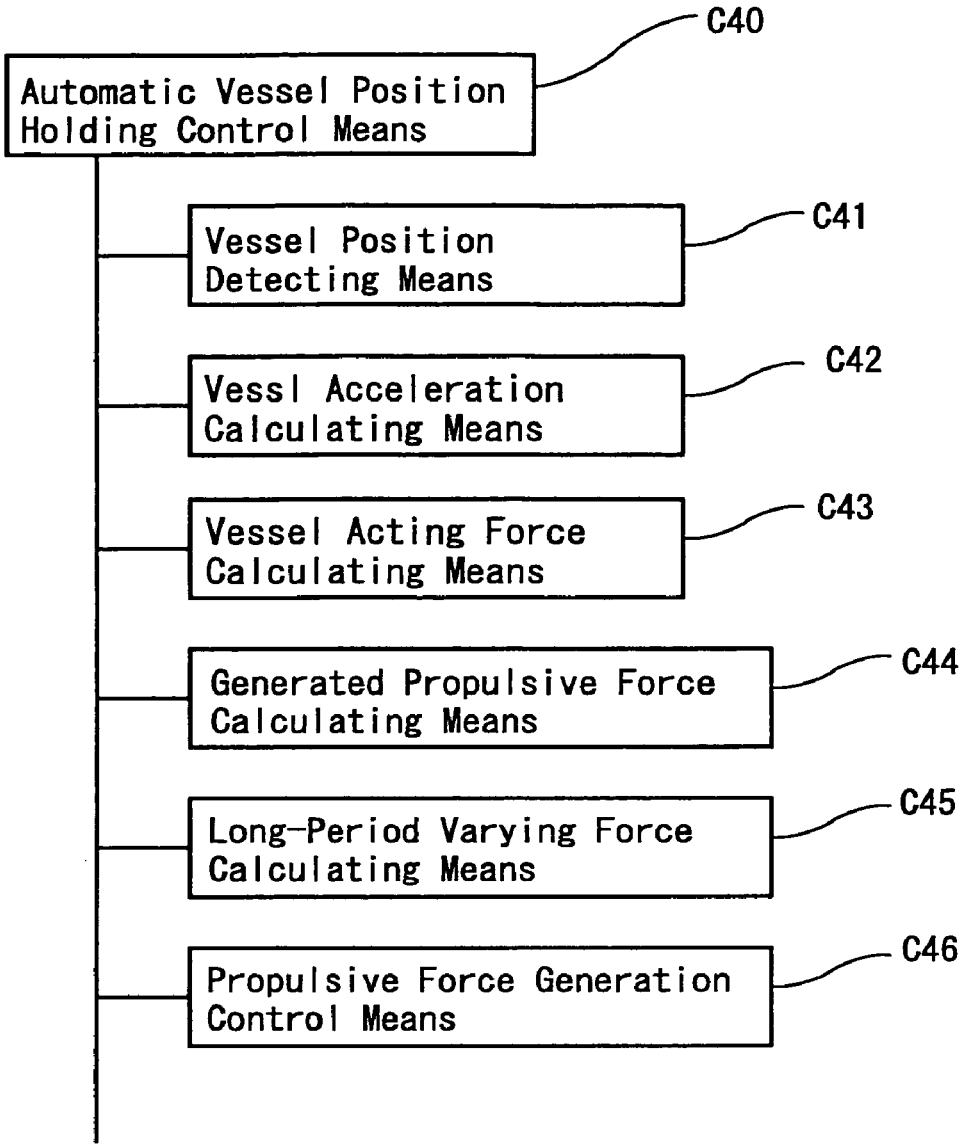
FIG. 6 is a diagram illustrating a configuration of control means of an automatic vessel position holding controller according to the present invention.

Control means C40 in the second embodiment of the automatic vessel position holding controller 20 comprises, as shown in FIG. 6, vessel position detecting means C41, vessel acceleration calculating means C42, vessel acting force calculating means C43, generated propulsive force calculating means C44, long-period varying force calculating means C45, and propulsive force generation control means C46.

The vessel position detecting means C41 detects a vessel position by a GPS device and also detects a vessel heading by a gyrocompass. And positional deviation and heading deviation are acquired by subtracting a target position and a target heading from the vessel position and the vessel heading. The vessel acceleration calculating means C42 applies second-order derivative to time-series data of the positional deviation and the heading deviation after passing them through Kalman filter so as to calculate acceleration and angular acceleration in the position of the center of gravity of the vessel.

The vessel acting force calculating means C43 calculates an acting force and an acting moment acting on the vessel by multiplying the acceleration and the angular acceleration detected by the vessel acceleration detecting means C42 by a hull virtual mass and a hull virtual inertia moment. The generated propulsive force calculating means C44 calculates a control force and a control moment generated by the propulsive force generating means 30 provided with the vessel.

The long-period varying force calculating means C45 calculates a long-period varying force and a long-period varying moment including the varying wave drifting force and the varying wave drifting moment by waves by subtracting the control force and the control moment calculated by the generated propulsive force calculating means C44 from the acting force and the acting moment calculated by the vessel acting force calculating means C43. The propulsive force generation control means C46 performs feedforward control of the control force and the control moment (FF control force) generated by the propulsive force generating means 30 for the long-period varying force and the long-period varying moment calculated by the long-period varying force calculating means C45.

Figure 7:
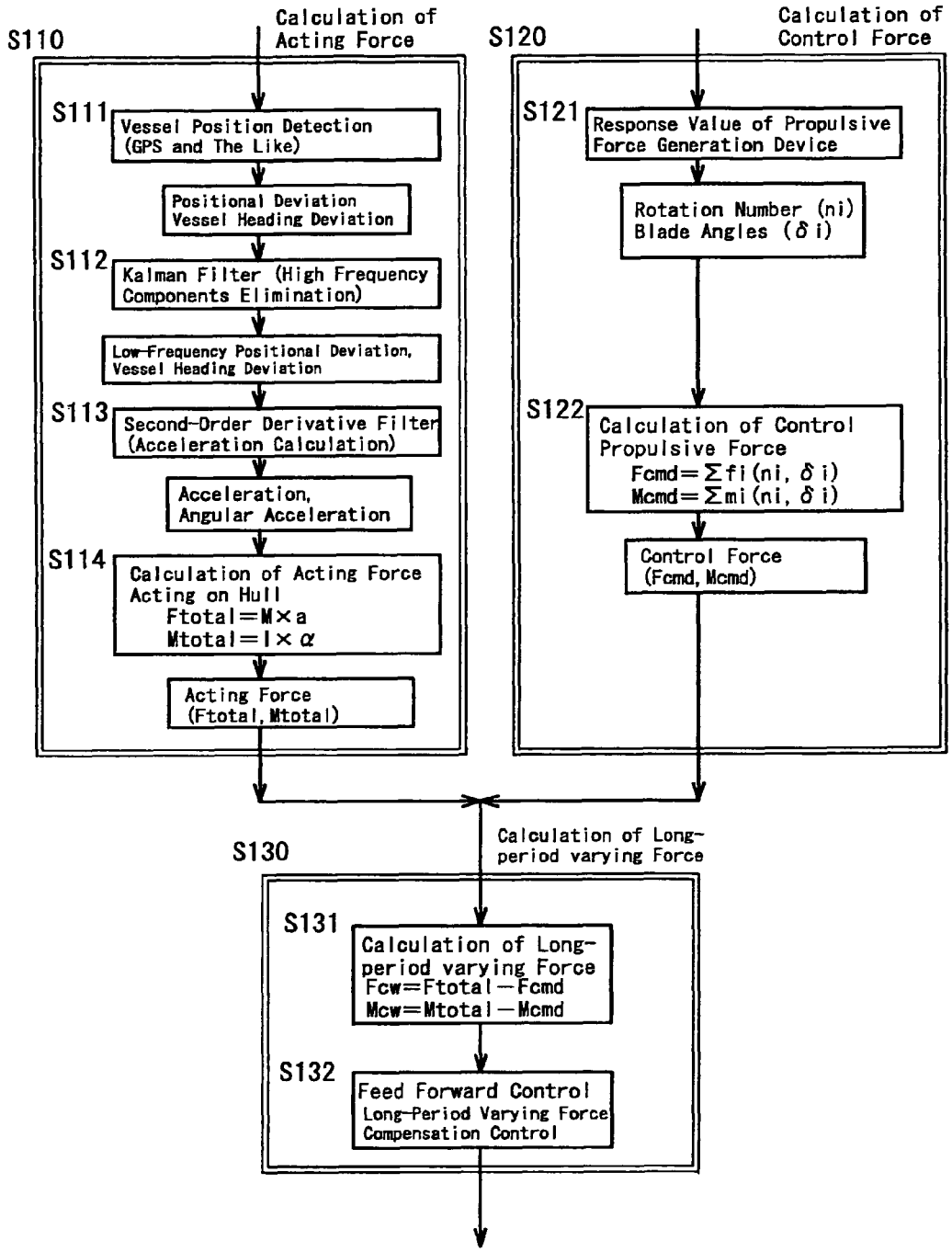
FIG. 7 is a diagram illustrating a long-period varying force compensation control flow according to the present invention.

Next, calculation of a compensation control force and a compensation control moment for the long-period varying force and the long-period varying moment will be described according to the long-period varying force compensation control flow shown in FIG. 7. The long-period varying force compensation control flow is calculation carried out in a time domain and data is handled as time-series data. Also, the long-period varying force compensation control flow is formed by an acting force calculation flow (Step S110) for calculating a force acting on a vessel, a control force calculation flow (Step S120), and a long-period varying force calculation flow (Step S130).

In the acting force calculation flow at the first Step S110, the longitudinal and lateral positions of the vessel (surge direction, sway direction) are detected by GPS or the like at Step S111. Also, the vessel heading (yaw direction) is detected by a gyrocompass. The positional deviation and the heading deviation (displacement) obtained from the vessel position and the vessel heading, is passed through Kalman filter at Step S112 so as to eliminate high frequency components to have a low-frequency positional deviation and a low-frequency heading deviation (low-frequency displacement).

The low-frequency positional deviation and the low-frequency heading deviation are passed through the second-order derivative filter at Step S113 so as to calculate acceleration and angular acceleration. At Step S114, from the calculated acceleration (a) and the angular acceleration ($\alpha$), a vessel acting force (Ftotal) and a vessel acting moment (Mtotal) acting on the vessel are calculated. This is carried out by multiplying the acceleration (a) by a virtual mass (M) of the hull or by multiplying the angular acceleration ($\alpha$) by a virtual inertia moment (I) of the hull. Through this, the vessel acting force (Ftotal) and the vessel acting moment (Mtotal) are obtained.

On the other hand, in the control force calculation flow at Step S120, responses of actuators 21 to 24 of the propulsive force generating device 20 are detected, and data including blade angles $\delta$1, $\delta$2 of variable pitch propellers of the main propellers 21, 22, rotation numbers n1, n2, steering angles $\delta$3, $\delta$4, blade angles $\delta$5 to $\delta$8 of variable pitch propellers of thrusters 25 to 28, rotation numbers n5 to n8 and the like is outputted to Step S122. At Step S122, a control force (Fcmd ($=\Sigma fi\ (ni, \delta i)$)), which is a total sum of the forces generated at the respective actuators of the propulsive force generating device 20 calculated as functions ($fi\ (ni, \delta i)$, $mi\ (ni, \delta i)$) of the blade angles (or steering angles) $\delta i$, the rotation numbers ni and the control moment (Mcmd ($=\Sigma mi\ (ni, \delta i)$) are calculated. By this, the control force (Fcmd) and the control moment (Mcmd), which are the forces generated by the propulsive force generating device 20 can be obtained.

At Step S131 of the long-period varying force calculation flow of Step S130, the control force (Fcmd) and the control moment (Mcmd) are subtracted from the vessel acting force (Ftotal) and the vessel acting moment (Mtotal) calculated in the acting force calculation flow. Through this, the long-period varying force (Fcw (=Ftotal−Fcmd)) and the long-period varying moment (Mcw (=Mtotal−Mcmd)) are calculated. And at Step S132, the force and the moment obtained by multiplying the long-period varying force and the long-period varying moment by minus, are put into the automatic vessel position holding control as the FF control force (including the moment) and given the feedforward control.

Also, the FF control force includes the wind pressure compensation control force and control moment relating to the wind pressure. However, based on the data of the relative wind direction and the relative wind force from the wind direction/wind indicator, the wind pressure and the wind pressure moment currently acting on the vessel can be estimated in real time. Therefore, the tidal force, the tidal moment, the varying wave drifting force and the varying wave drifting moment remain by subtracting the estimated wind pressure and the wind pressure moment from the FF control force. Alternatively, when the tidal force and the tidal moment do not have to be considered, the varying wave drifting force and the varying wave drifting moment remain.

According to the automatic vessel position holding control method and the automatic vessel position holding controller 20 in the second embodiment, the long-period varying force and the long-period varying moment acting on the vessel can be detected at an early stage, and the feedforward control for compensating the long-period varying force and the long-period varying moment including the long-period varying wave drifting force and varying wave drifting moment generated by waves, is performed. Therefore, the positional deviation and the heading deviation can be made extremely smaller than the conventional automatic vessel position holding controller.

INDUSTRIAL APPLICABILITY

The automatic vessel position holding control method and the automatic vessel position holding control system according to the present invention having the above-mentioned excellent effect, can make the positional deviation and the heading deviation extremely smaller than the conventional automatic vessel position holding control, by performing feedforward control for compensating at least one of the wave drifting force and the wave drifting moment through estimation of at least one of the wave drifting force and the wave drifting moment acting on the vessel. Alternatively, the positional deviation can be made extremely smaller than the conventional automatic vessel position holding controller, by performing the feedforward control for compensating the long-period varying force through estimation of the long-period varying force and the long-period varying moment including at least one of the varying wave drifting force and the varying wave drifting moment acting on the vessel. Therefore, the present invention can be extremely effectively utilized as an automatic vessel position holding control method and a dynamic positioning system of ships such as workboats and research ships and marine structures.

What is claimed is:

1. An automatic vessel position holding control method to hold a vessel position and a vessel heading of a vessel on the ocean using an automatic vessel position holding controller which is provided with vessel motion measuring means, wave information estimating means, pitch response value calculating means, wave time-series calculating means, and wave drifting force calculating means, wherein, by the automatic vessel position holding controller, a vessel position holding control is performed including a control in which at least one of a wave drifting force and a wave drifting moment caused by waves is calculated and a feedforward control is performed for at least one of a calculated wave drifting force and a calculated wave drifting moment, comprising measuring, by the vessel motion measuring means, motions of the vessel including at least a pitch and a roll;

calculating, by the wave information estimating means, a pitch representative period from a pitch measured time series;

estimating, by the wave information estimating means, a wave incident angle from a measured response ratio between a measured pitch and a measured roll based on the pitch representative period using a wave incident angle estimation table prepared in advance;

calculating, by the pitch response value calculating means, a pitch response value from the pitch representative period and the wave incident angle using a pitch response value table in short crest irregular waves prepared in advance;

calculating, by the wave time-series calculating means, estimated time series of waves by multiplying the pitch measured time series by the inverse of the pitch response value; and calculating, by the wave drifting force calculating means, at least one of the wave drifting force and the wave drifting moment from the estimated time series of waves.

2. The automatic vessel position holding control method according to claim 1, wherein, when at least one of the wave drifting force and the wave drifting moment is calculated from the estimated time series of waves, from a period between zero crosses of the estimated time series of waves and a wave height between the zero crosses, at least one of the wave drifting force and the wave drifting moment in regular waves corresponding to the period and the wave height per half wave-length is calculated by the wave drifting force calculating means, and at least one of the wave drifting force and the wave drifting moment in the regular waves is set as at least one of the wave drifting force and the wave drifting moment.

3. A wave drifting force estimating method to estimate at least one of a wave drifting force and a wave drifting moment acting on a vessel on the ocean using an automatic vessel position holding controller which is provided with vessel motion measuring means, wave information estimating means, pitch response value calculating means, wave time-series calculating means, and wave drifting force calculating means, comprising measuring, by the vessel motion measuring means, motions of the vessel including at least a pitch and a roll;

calculating, by the wave information estimating means, a pitch representative period from a pitch measured time series;

estimating, by the wave information estimating means, a wave incident angle from a measured response ratio between a measured pitch and a measured roll based on the pitch representative period using a wave incident angle estimation table prepared in advance;

calculating, by the pitch response value calculating means, a pitch response value from the pitch representative period and the wave incident angle using a pitch response coefficient table in short crest irregular wave prepared in advance;

calculating, by the wave time-series calculating means, estimated time series of waves by multiplying the pitch measured time series by the inverse of the pitch response value; and calculating, by the wave drifting force calculating means, at least one of the wave drifting force and the wave drifting moment from the estimated time series of waves.

4. An automatic vessel position holding controller for holding a vessel position and a vessel heading of a vessel on the ocean, comprising:

vessel motion measuring means for measuring motions of the vessel including at least a pitch and a roll;

wave information estimating means for calculating a pitch representative period from a pitch measured time series and estimating a wave incident angle from a measured response ratio between a measured pitch and a measured roll based on the pitch representative period using a wave incident angle estimation table prepared in advance;

pitch response value calculating means for calculating a pitch response value from the pitch representative period and the wave incident angle using a pitch response coefficient table in short-crest irregular wave prepared in advance;

wave time-series calculating means for calculating estimated time series of waves by multiplying the pitch measured time series by the inverse of the pitch response value; and wave drifting force calculating means for calculating at least one of the wave drifting force and the wave drifting moment from the estimated time series of waves.

5. The automatic vessel position holding controller according to claim 4, wherein when the wave drifting force calculating means calculates at least one of the wave drifting force and the wave drifting moment from the estimated time series of waves, from a period between zero crosses of the estimated time series of waves and a wave height between the zero crosses, at least one of the wave drifting force and the wave drifting moment in regular waves corresponding to the period and the wave height per half wave-length is calculated and at least one of the wave drifting force and the wave drifting moment in the regular wave is set as at least one of the wave drifting force and the wave drifting moment.

6. A dynamic positioning system for holding a vessel position and a vessel heading of a vessel on the ocean, comprising the automatic vessel position holding controller according to claim 4.

7. A dynamic positioning system for holding a vessel position and a vessel heading of a vessel on the ocean, comprising the automatic vessel position holding controller according to claim 5.

* * * * *